US006188320B1

(12) United States Patent
Kolton et al.

(10) Patent No.: US 6,188,320 B1
(45) Date of Patent: Feb. 13, 2001

(54) ARTICLE IDENTIFICATION AND SURVEILLANCE TAG HAVING-ARTICLE-ENGAGING LOOP

(75) Inventors: Chester Kolton, Westfield; Michael Norman, East Brunswick, both of NJ (US); Roberto Peruzzo, Valdagno (IT)

(73) Assignee: B&G Plastics, Inc., Newark, NJ (US)

( * ) Notice: Under 35 U.S.C. 154(b), the term of this patent shall be extended for 0 days.

(21) Appl. No.: 09/363,260

(22) Filed: Jul. 29, 1999

(51) Int. Cl.[7] ..... G08B 13/14

(52) U.S. Cl. ..... 340/572.9; 340/572.1; 340/571; 340/568.1; 340/568.4

(58) Field of Search ..... 340/572.9, 572.1, 340/571, 568.1, 568.4

(56) References Cited

U.S. PATENT DOCUMENTS 4,708,306 * 11/1987 Mitomi ..... 248/74.3
5,079,540 * 1/1992 Narlow et al. ..... 340/572
5,513,421 * 5/1996 Wells ..... 24/16 PB
5,945,909 * 8/1999 Kolton ..... 340/572.1
5,949,336 * 9/1999 Deschenes et al. ..... 340/572.8
6,052,876 * 4/2000 Hogan et al. ..... 24/704.1

* cited by examiner

*Primary Examiner*—Daniel J. Wu
*Assistant Examiner*—Tai T. Nguyen
(74) *Attorney, Agent, or Firm*—Robin, Blecker & Daley

(57) ABSTRACT

An article identification tag comprises a body defining a channel extending therethrough, an article engaging element forming a loop exteriorly of the body and a portion continuous with the loop extending into and through the channel to a pulling member accessible exteriorly of the body, a size of the loop being changeable by pulling of the pulling member, and structure disposed in the body for maintaining the loop in its changed size.

13 Claims, 6 Drawing Sheets

ARTICLE IDENTIFICATION AND SURVEILLANCE TAG HAVING-ARTICLE-ENGAGING LOOP

FIELD OF THE INVENTION

This invention relates generally to article identification and protection and pertains more particularly to tags having size-adaptiveness to articles.

BACKGROUND OF THE INVENTION

One type of article identification device having security aspects and having virtual universal applicability to articles is the so-called "seal", such as is shown in Mainetti U.S. Pat. No. 5,306,055. The seal of the '055 patent comprises a plastic body having a flexible cord passing through and secured in the body and extending outwardly of the body to a cord free end which has hooks secured thereto and of configuration providing for irreversible insertion in the plastic body. In addition to the body and the cord, the seal of the '055 patent has plates bearing logo/article indication applied to the plastic body to close the same. In use, the hook and cord are passed through an opening of, e.g., a watch band, and the hook is then inserted into the plastic body.

A widespread further practice in article security is the use of so-called anti-theft tags which incorporate electronic article surveillance (EAS) markers. Such tags are secured to articles and are removed or rendered inactive at checkout. Where fraudulent avoidance of checkout (shop-lifting) occurs, the markers are sensed by EAS systems, e.g., at store exits, and suitable alarm is generated.

One form of EAS marker in widespread use is in the form of a flat, thin, flexible, rectangular member which is applied adhesively to flat or curved surfaces of articles.

In pending, allowed U.S. patent application Ser. No. 09/088,839, commonly-assigned herewith, there is shown a seal incorporating therewithin an EAS marker.

Known seals, such as those above discussed, have a common shortcoming in that they are not adaptive to the size of articles with which they are assembled.

SUMMARY OF THE INVENTION

The primary object of the subject invention is to provide tags which are adaptive to the size of articles with which they are assembled.

In broad aspect, the invention provides tags, the article engaging elements of which can tightly circumscribe articles of different sizes. To this end, the tag body of tags in accordance with the invention supports the article engagement element or elements in the form of a loop which can take on a diameter adaptive to the size of an article inserted through the loop. To ensure maintenance of tight engagement between the encircling loop and the article, applicants embody means for precluding or substantially limiting movement of the article engagement element once tight engagement is achieved.

More particularly, the invention provides a tag comprising a body having a tail with one tail end peripherally continuous with a first end of the body and defining a loop exteriorly of the body, the tail extending from the loop into the body, the body including means for precluding tail movement or substantially limiting movement of the tail relative to the body to a single direction of movement.

The body defines an interior compartment and the tag further may include an EAS marker situated in the body interior compartment.

The body preferably defines an interior channel opening into the body first end, the movement precluding/limiting means being disposed in the channel and preferably being a one-way clutch.

The body may comprise first and second body members closable upon one another, the first body member defining the interior compartment and the second body member defining the channel.

The invention will be further understood from consideration of the following description of preferred embodiments thereof and from the drawings where like reference numerals identify like parts throughout.

DETAILED DESCRIPTION OF THE PREFERRED EMBODIMENTS

Figure 2:
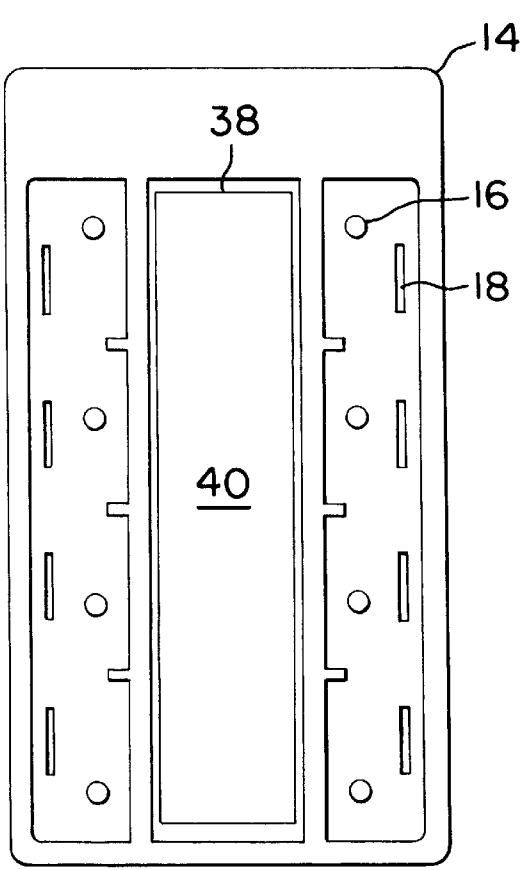
FIG. 2 is a plan elevation of a second body part of the first tag embodiment.
Figure 1:
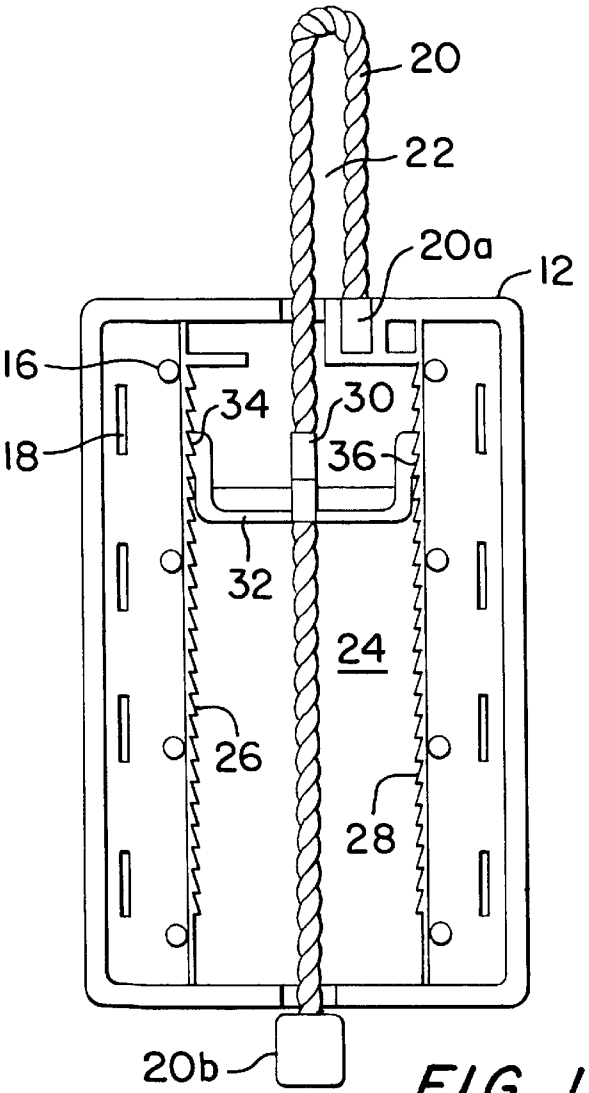
FIG. 1 is a plan elevation of one body part of a first tag embodiment in accordance with the invention.
Figure 3:
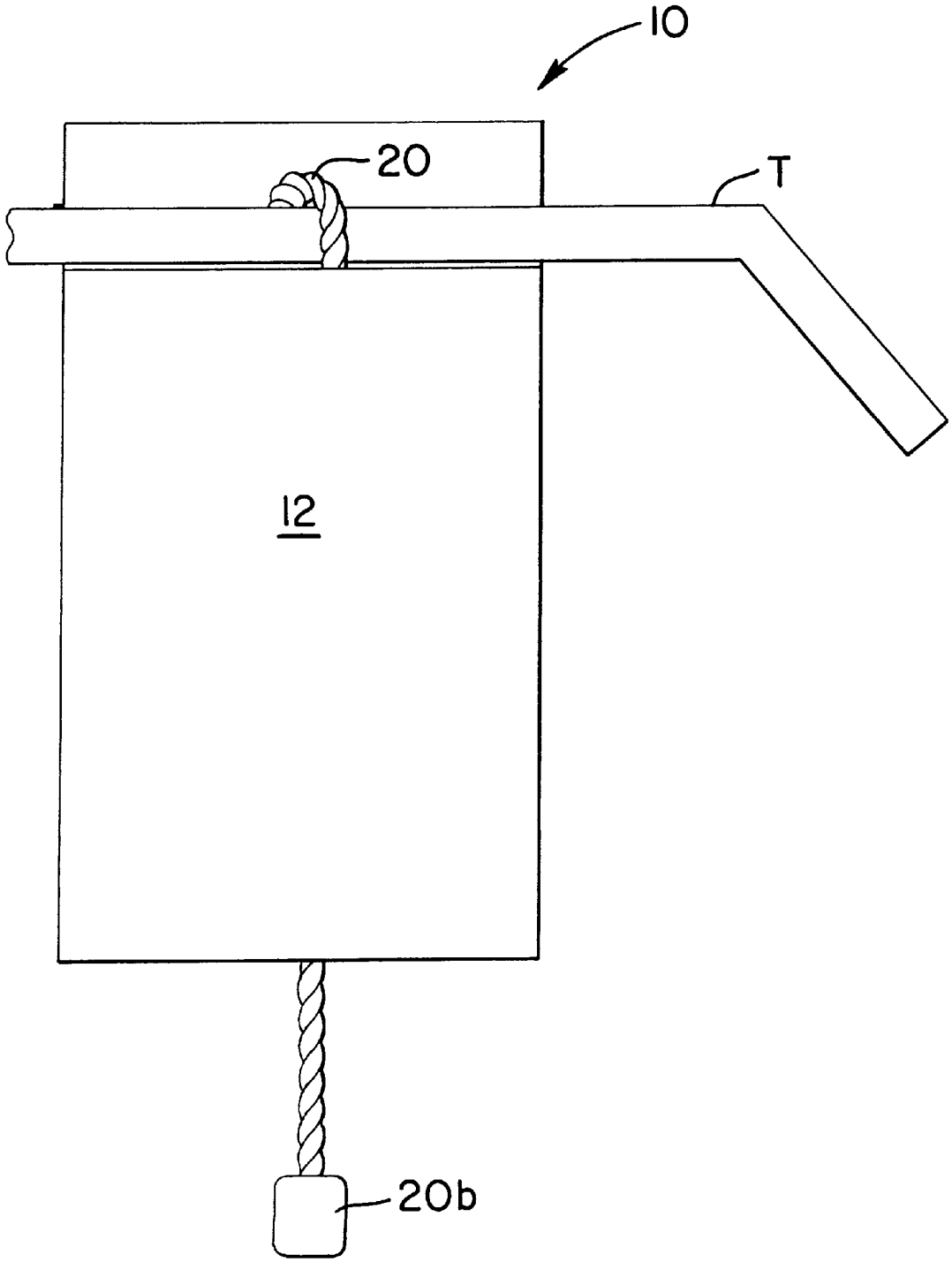
FIG. 3 is a plan elevation of the assembled first tag embodiment, shown in engagement with a temple of eyeglasses.

Referring to FIGS. 1–3, tag 10 is a plastic body comprised of housings 12 and 14 having respective sets of projections 16 and openings 18 for guiding assembly of the housings which are then mutually secured as by heat welding of their mating faces about the periphery of tag 10.

Tail 20 has one tail end 20*a* peripherally continuous with a first end of housing 12 and defines a loop 22 exteriorly of the housing, the tail extending from the loop into the housing and therethrough to tail end piece 20*b*, which is accessible exteriorly of tag 10.

Housing 12 defines an interior generally rectangular channel 24, the walls of which are formed with facing ratchets 26 and 28. Secured to tail 20 interiorly of housing 12 is a collar 30 of pawl member 32. The outer walls of pawl member 32 are formed with teeth 34 and 36, which are in engagement respectively with ratchets 26 and 28.

As is evident from the configurations of ratchets 26 and 28 and teeth 34 and 36, pawl member 32 is movable only in one direction, i.e., downwardly in FIG. 1, upon downward pulling of tail end piece 20*b*. The ratchets and teeth thus form a one-way clutch, which precludes upward movement of pawl member 32.

Turning to FIG. 2, housing 14 defines an interior compartment 38, in which is disposed EAS member 40.

In assembly of tag 10, pawl member 32 is inserted from above into channel 24, desirably in the uppermost end of the channel, i.e. somewhat above its disposition shown for clarity in FIG. 1. This permits the dimension of loop 22 to be at its maximum. EAS member 40 is placed in compartment 38 of housing 14 and the housings are then secured to one another.

In FIG. 3, tag 10 is shown assembled with eyeglass temple T. In reaching this assembly, temple T is guided into and through loop 22. Then tail end piece 20*b* is pulled downwardly, reducing the dimensions of loop 22, such that tail 20 is tightly secured to temple T.

Figure 4:
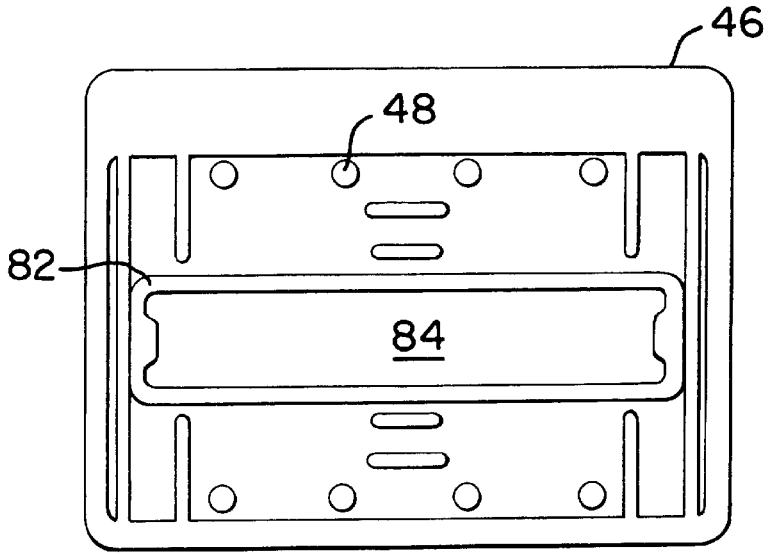
FIG. 4 is a plan elevation of one body part of a second tag embodiment in accordance with the invention.
Figure 5:
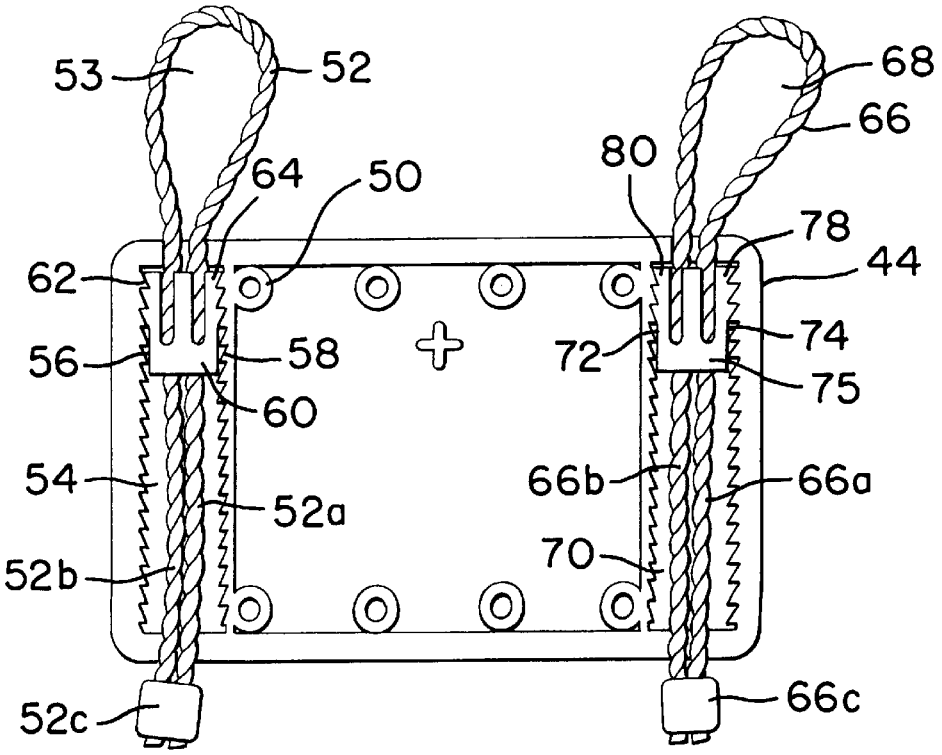
FIG. 5 is a plan elevation of a second body part of the second tag embodiment.
Figure 6:
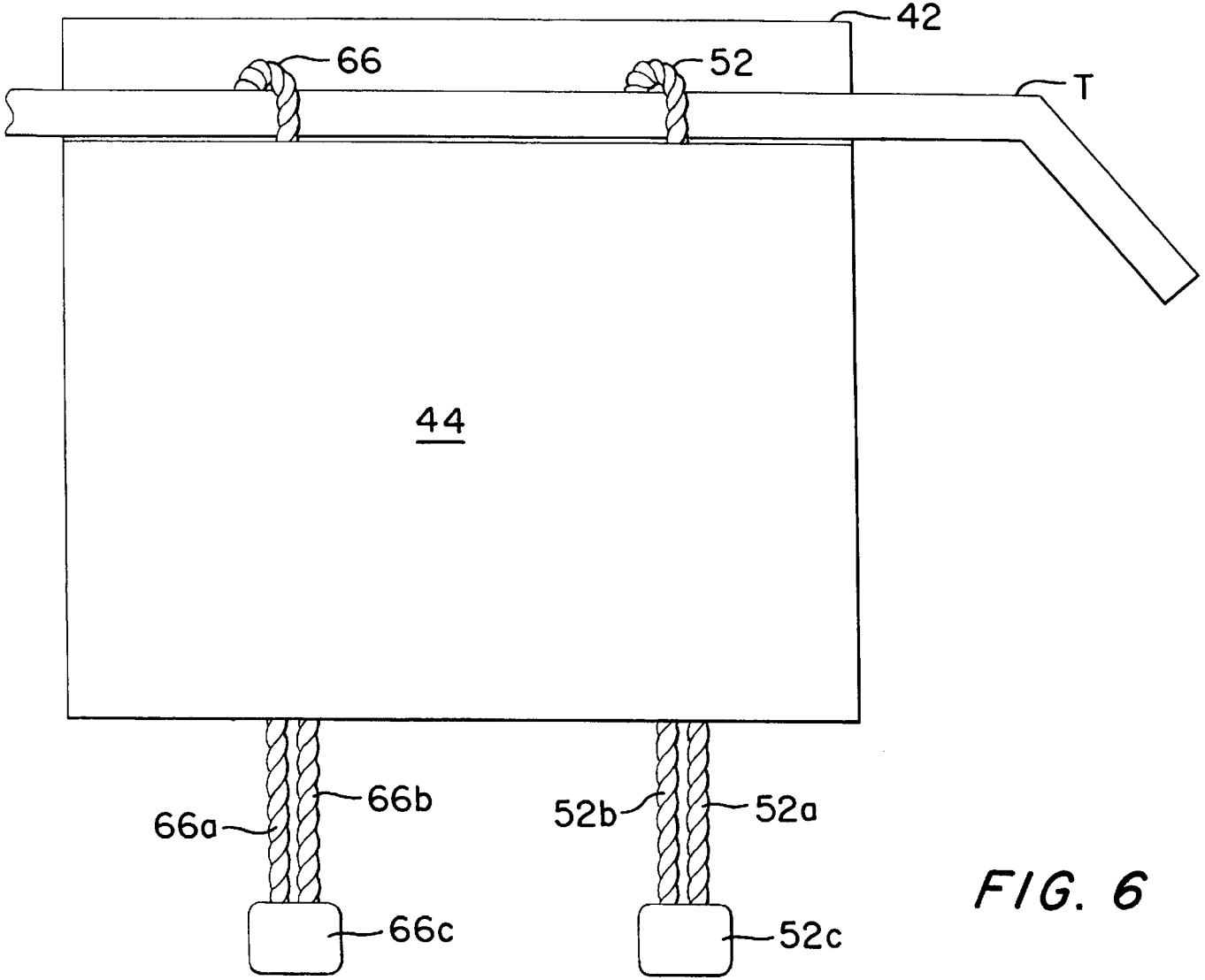
FIG. 6 is a plan elevation of the assembled second tag embodiment, shown in engagement with a temple of eyeglasses.

Referring to FIGS. 4–6, second embodiment tag 42 is a plastic body comprised of housings 44 and 46 having respective sets of projections 48 and openings 50 for guiding assembly of the housings which are then mutually secured as by heat welding of their mating faces about the periphery of tag 42.

Tail 52 defines a loop 53 exteriorly of the housing, the tail extending from the loop in tail parts 52*a* and 52*b*, ends of which are joined in member 52*c*, which is accessible exteriorly of tag 42.

Housing 44 defines an interior generally rectangular channel 54, the walls of which are formed with facing ratchets 56 and 58. Secured to tail 52 interiorly of housing 44 is a pawl member 60. The outer walls of pawl member 60 are formed with teeth 62 and 64, which are in engagement respectively with ratchets 56 and 58.

As is evident from the configurations of ratchets 56 and 58 and teeth 62 and 64, pawl member 60 is movable only in one direction, i.e., downwardly in FIG. 5, upon downward pulling of member 52*c*. The ratchets and teeth thus form a one-way clutch, which precludes upward movement of pawl member 60.

Tail 66 defines a loop 68 exteriorly of the housing, the tail extending from the loop in tail parts 66*a* and 66*b*, ends of which are joined in member 66*c*, which is accessible exteriorly of tag 42.

Housing 44 defines a second interior generally rectangular channel 70, the walls of which are formed with facing ratchets 72 and 74. Secured to tail 66 interiorly of housing 44 is a pawl member 75. The outer walls of pawl member 75 are formed with teeth 78 and 80, which are in engagement respectively with ratchets 74 and 72.

As is evident from the configurations of ratchets 72 and 74 and teeth 78 and 80, pawl member 76 is movable only in one direction, i.e., downwardly in FIG. 5, upon downward pulling of member 66*c*. The ratchets and teeth thus form a one-way clutch, which precludes upward movement of pawl member 76.

Turning to FIG. 4, housing 14 defines an interior compartment 82, in which is disposed EAS member 84.

In assembly of tag 42, pawl members 60 and 75 are inserted from above into channels 54 and 70, desirably in the uppermost end of the channel, i.e. in their FIG. 5 dispositions. EAS member 84 is placed in compartment 82 of housing 46 and the housings are then secured to one another.

In FIG. 6, tag 42 is shown assembled with eyeglass temple T. In reaching this assembly, temple T is guided into and through loops 53 and 68. Then, members 52*c* and 66*c* are pulled downwardly, reducing the dimensions of loops 53 and 68, such that tails 52 and 66 are tightly secured to temple T.

Figure 7:
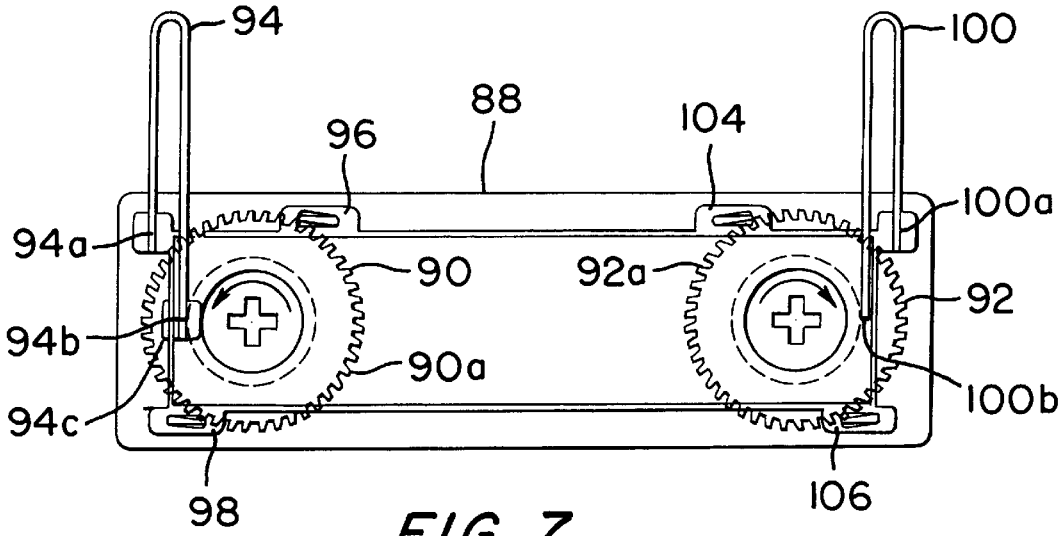
FIG. 7 is a plan elevation of one body part of a third tag embodiment in accordance with the invention.
Figure 8:
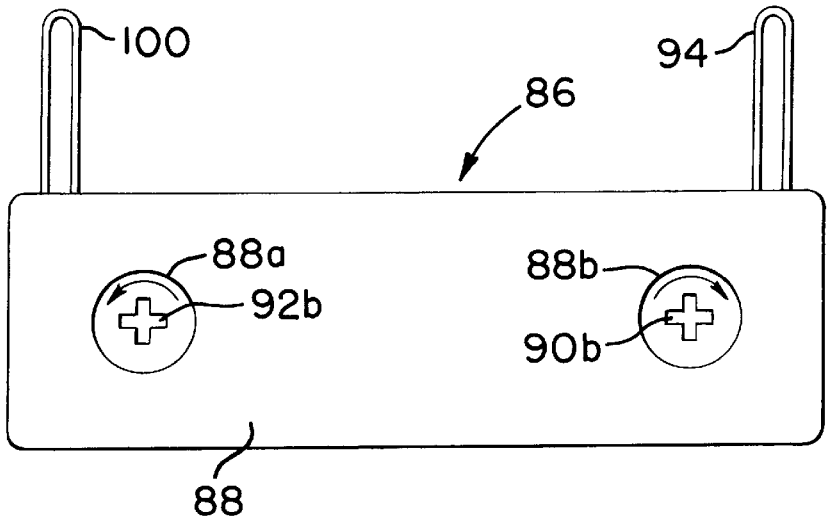
FIG. 8 is a plan elevation of the assembled third tag embodiment.
Figure 9:
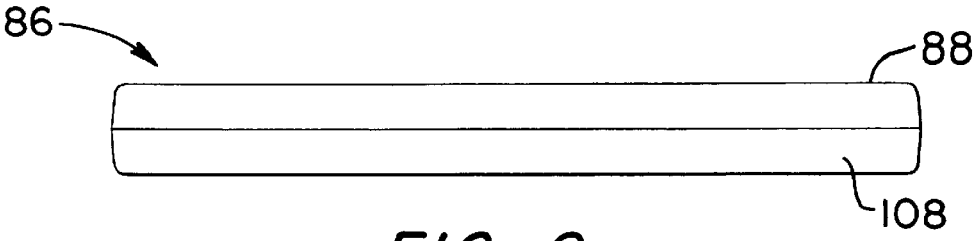
FIG. 9 is an underside elevation of the FIG. 8 tag embodiment.

Turning to FIGS. 7–9, third embodiment tag 86 includes housing 88 which supports ratchet wheels 90 and 92 for rotation. Tail 94 has its end 94*a* secured with housing 88 and its end 94*b* secured to end member 94*c*, which is in turn secured to wheel 90 for rotation therewith. Peripheral teeth 90 of wheel 90 are configured with stop members 96 and 98 to permit only counterclockwise movement of wheel 90 and hence only movement of tail end 94*b* counterclockwise in FIG. 7.

Tail 100 has its end 102*a* secured with housing 88 and, to show an alternative means in accordance with the invention, its end 102*b* molded with wheel 92. Peripheral teeth 92*a* of wheel 92 are configured with stop members 96 and 98 to permit only clockwise movement of wheel 92 and hence only movement of tail end 100*b* clockwise in FIG. 7.

Housing 108, which desirably contains an EAS member, is sealed to housing 88 to form tag 86.

As is seen in FIG. 8, housing 88 defines circular windows 88*a* and 88*b*, which permit access to keys 90*b* and 92*b* of wheels 90 and 92, whereby a user can effect turning of the wheels to tighten tails 94 and 100 upon a temple of eyeglasses or other object desired to be identified and protected. Logo, bar code data and price data may of course be provided on the surface of housing 88.

Figure 10:
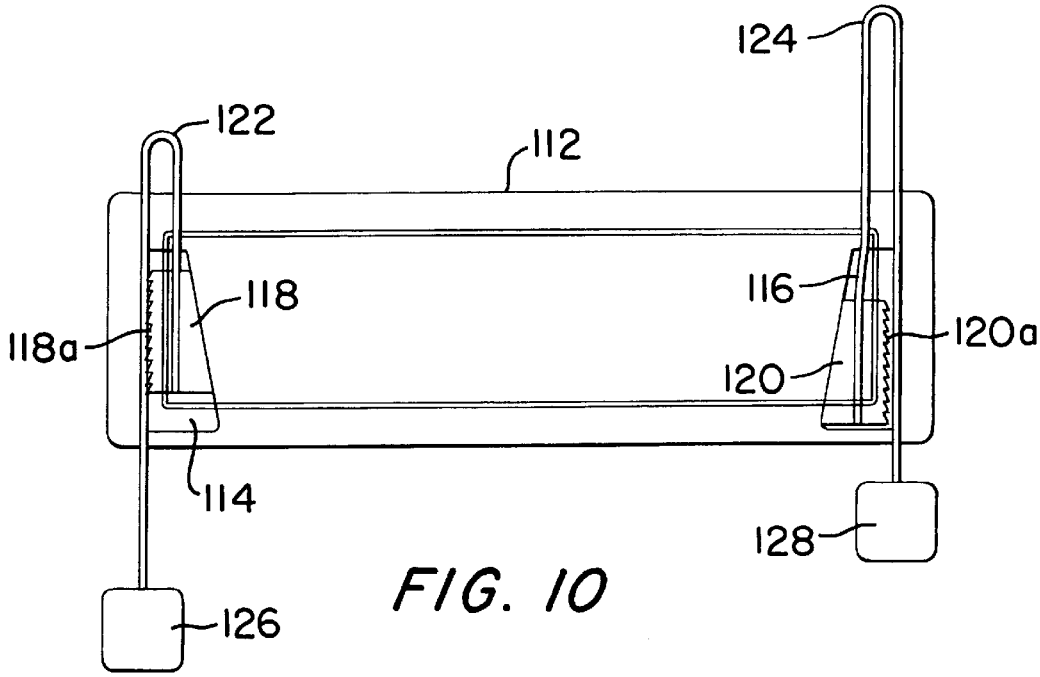
FIG. 10 is a plan elevation of one body part of a fourth tag embodiment in accordance with the invention.
Figure 11:
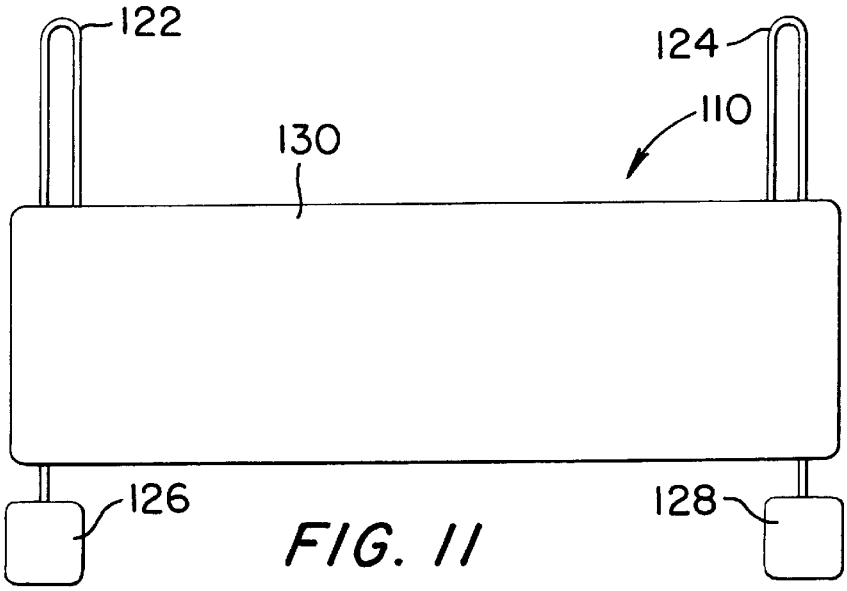
FIG. 11 is a plan elevation of the assembled fourth tag embodiment.
Figure 12:
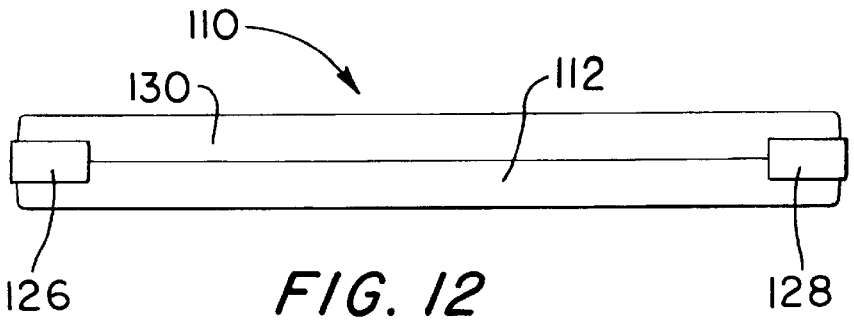
FIG. 12 is an underside elevation of the FIG. 11 tag embodiment.

Turning to FIGS. 10–12, fourth tag embodiment 110 includes housing 112 which defines wedge-shaped channels 114 and 116 extending from its bottom surface and terminating within housing 112 as illustrated in FIG. 10. Wedge members 118 and 120 define respective teeth 118*a* and 120*a* and are configured to move into channels 114 and 116.

Tails 122 and 124 have first ends thereof secured to housing 112 and second ends secured to end members 126 and 128, which are accessible exteriorly of housing 112.

In the illustration of tail 124 in FIG. 10, the tail defines a full loop above housing 112 and end member 128 can be pulled downwardly, tail 124 not being restrained by teeth 120*a* of wedge member 120, which has not yet been inserted fully into channel 116. In the illustration of tail 122 in FIG. 10, on the other hand, end member 126 has been pulled down for securement of the tail tightly to an article (not shown) and wedge member 118 has been fully inserted into channel 114 with teeth 118*a* tightly engaging the tail and precluding upward or downward movement of the tail.

Various changes may be introduced in the disclosed preferred embodiments without departing from the invention. For example, while the tails are shown as being disposed in the housing not defining the EAS member compartment, they may be disposed jointly with the EAS member in the housing defining the EAS member compartment. Further, the EAS member compartment may include plural recesses for residence of plural EAS components. Accordingly, it is to be appreciated that the true spirit and scope of the invention is set forth in the following claims.

What is claimed is:

1. An article identification and surveillance tag assembly comprising a housing defining an interior channel opening into at least one end of said housing, a flexible tail having one tail end peripherally continuous with a first end of said housing, said cord defining a loop exteriorly of said housing, said tail having a portion successive to said loop disposed in said interior channel, said tail portion having at least a part thereof which is not removable from said housing, engaging means disposed in said channel for moving said tail portion only unidirectionally in said channel to change the size of said loop and for maintaining said loop in its changed size, and an EAS marker disposed interiorly of said housing.

2. The tag assembly cl aimed in claim 1, wherein said engaging means comprises a one-way clutch.

3. The tag assembly claimed in claim 2 wherein said one-way clutch includes a first clutch member secured to said tail and a second clutch member formed on a wall of said channel.

4. The tag assembly claimed in claim 3 wherein said first clutch member is movable in only one direction in said channel.

5. The tag assembly claimed in claim 2 wherein said one-way clutch includes a clutch member supported for single sense rotation in said housing.

6. The tag assembly claimed in claim 5 wherein a second end of said tail is secured to said clutch member.

7. The tag assembly claimed in claim 6 wherein said clutch member includes means accessible exteriorly of said housing for rotation of said clutch member.

8. The tag assembly claimed in claim 6 wherein said clutch member includes a plurality of teeth in engagement with said tail portion.

9. The tag assembly claimed in claim 8, wherein said engaging means comprises a member disposed in said channel in frictional engagement with said tail portion.

10. The tag assembly claimed in claim 8 wherein said engaging means comprises a member disposable in said channel in a first position permitting movement of said tail portion relative to said housing and moveable therefrom to a second position wherein said member is in frictional engagement with said tail portion and precludes movement thereof relative to said housing.

11. The tag assembly claimed in claim 1, wherein said interior channel opens into a second end of said housing, said engaging means being disposed in said channel adjacent said second end of said housing.

12. The tag claimed in claim 1 wherein said housing comprises first and second housing members closable upon one another, said first housing member defining said channel and said second housing member containing said EAS marker.

13. In combination:

an article identification and surveillance tag assembly comprising a housing defining an interior channel opening into at least one end of said housing, a flexible tail having one tail end peripherally continuous with a first end of said housing, said cord defining a loop exteriorly of said housing, said tail having a portion successive to said loop disposed in said interior channel said tail portion having at least a part thereof which is not removable from said housing, engaging means disposed in said channel for moving said tail portion only unidirectionally in said channel to change the size of said loop and for maintaining said loop in its changed size, and an EAS marker disposed interiorly of said housing; and eyeglasses having a temple disposed in said changed size loop.

* * * * *